US006718807B2

(12) United States Patent
Andersson

(10) Patent No.: US 6,718,807 B2
(45) Date of Patent: Apr. 13, 2004

(54) LOCK DEVICE WITH REMOVABLE CORE

(75) Inventor: Daniel Andersson, Eskilstuna (SE)

(73) Assignee: Assa AB, Eskilstuna (SE)

( * ) Notice: Subject to any disclaimer, the term of this patent is extended or adjusted under 35 U.S.C. 154(b) by 0 days.

(21) Appl. No.: 10/197,405

(22) Filed: Jul. 18, 2002

(65) Prior Publication Data

US 2004/0011099 A1 Jan. 22, 2004

(51) Int. Cl.[7] ..... E05B 27/00
(52) U.S. Cl. ..... 70/371; 70/369; 70/372
(58) Field of Search ..... 70/367, 368, 369, 70/371, 372

(56) References Cited

U.S. PATENT DOCUMENTS

| | | | | | |
|---|---|---|---|---|---|
| 3,206,958 | A | * | 9/1965 | Best | 70/369 |
| 3,324,693 | A | * | 6/1967 | Check | 70/369 |
| 3,603,123 | A | * | 9/1971 | Best | 70/369 |
| 3,713,311 | A | * | 1/1973 | Oliver et al. | 70/369 |
| 5,070,715 | A | | 12/1991 | Smallegan et al. | |
| 5,507,163 | A | * | 4/1996 | Juang | 70/369 |
| RE35,518 | E | * | 5/1997 | Sussina | 70/369 |
| 6,079,240 | A | * | 6/2000 | Shvarts | 70/372 |

* cited by examiner

*Primary Examiner*—Anthony Knight
*Assistant Examiner*—Christopher Boswell
(74) *Attorney, Agent, or Firm*—Sughrue Mion, PLLC

(57) ABSTRACT

A removable core lock and key device comprises a cylinder housing (3), a cylinder core (10) accommodated in said cylinder housing, and an essentially cylindrical plug (20) rotatably arranged in the core. A blocking pin (28) is provided in the core and is movable between an extended position, wherein it engages a recess in the cylinder housing, and a retracted position. An actuator element (26*a*, 26*c*) is controlled by at least one control pin tumbler. With a control key in the lock, the control pin tumbler displaces the actuator element so that it moves the blocking pin with the rotation of said plug. With a user key in said key slot, said pin tumbler is disengaged from the actuator element and the plug is free to rotate. In other positions the control pin tumbler blocks rotation of the plug and actuator element. A simple yet reliable and secure removable core arrangement is provided.

9 Claims, 3 Drawing Sheets

LOCK DEVICE WITH REMOVABLE CORE

FIELD OF INVENTION

The present invention relates generally to lock devices and, more particularly, to a lock assembly with a key-activated removable core structure.

BACKGROUND

A cylinder lock comprises a central plug or core and an outer shell or housing, in which the core rotates. The housing is mounted in a suitable latch structure. A number of prior art disclosures describe devices intended to provide a removable core in a cylinder lock. The advantage of removable core locks is that they may be rapidly re-keyed by relatively unskilled personnel. Such re-keying may be required as a result of a potential security breach or occurring due to the loss or non-return of a key.

The patent publication U.S. Pat. No. 5,070,715 (Smallegan et.al.) describes a removable core lock wherein a locking pin is arranged to engage a recess in the lock housing. The locking pin is actuated by means of a dedicated key operated control pin engaging an actuating ring and deactivating a locking pin stop latch.

While this solution provides for a reliable removable core, it is accompanied by several drawbacks. Firstly, a dedicated locking pin is used which cannot be used for coding of the lock and which contributes to the volume occupied by the core. Secondly, the control key used for operating the control pin is longer than user keys, necessitating key blanks of different lengths. Thirdly, the blocking arrangement comprises many parts, contributing to the cost of the lock. Lastly, the control pin can be manipulated by a fraudulent person trying to remove the core.

SUMMARY OF THE INVENTION

An object of the present invention is to provide a removable core lock wherein the drawbacks of prior art devices are eliminated or at least mitigated.

The invention is based on the realization that one of the pin tumblers used for blocking the rotation of the key plug can be used to control an actuator element controlling a locking element preventing or allowing removal of the cylinder core.

According to the invention there is provided a removable core lock and key device as defined in claim 1.

With the inventive device the above-mentioned drawbacks of prior art are eliminated or at least mitigated. The lock device according to the present invention as defined by the appended claims has a configuration wherein a simple design involving an actuator element and a blocking element provides the removable core function.

In a particularly preferred embodiment, an actuator element comprises an actuator ring arranged around the plug, wherein the ring has a hole for at least one control pin tumbler.

Further preferred features are defined in the dependent claims.

BRIEF DESCRIPTION OF DRAWINGS

The invention is now described, by way of example, with reference to the accompanying drawings, in which.

DETAILED DESCRIPTION OF THE INVENTION

Figure 1:
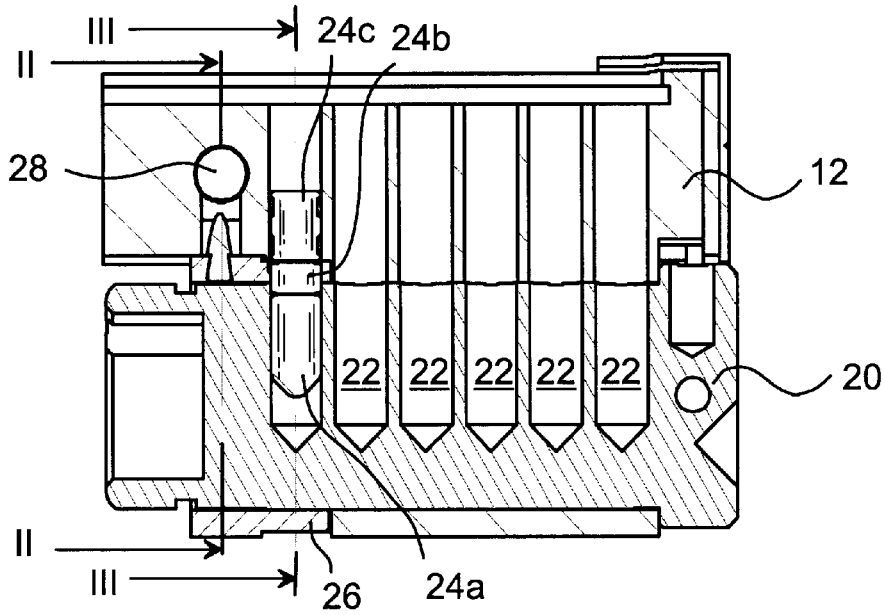
FIG. 1 shows a longitudinal elevation cross section through the lock arrangement according to the invention wherein a blocking pin engages the lock housing.
Figure 2:
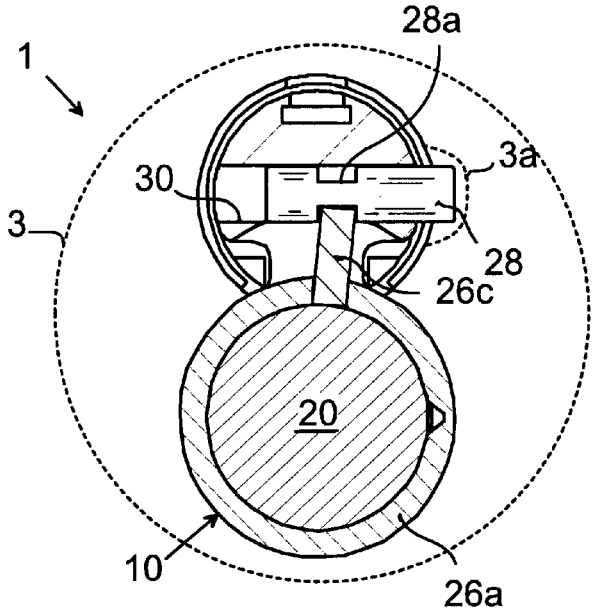
FIGS. 2 and 3 are transverse cross sectional views from lines II-II and III-III, respectively, of FIG. 1.

In the following a detailed description of a preferred embodiment of the present invention will be given. In FIG. 2 there is shown a cross-sectional view of a lock cylinder, generally designated 1. The cylinder comprises a generally cylindrical housing, the outline of which is indicated by a dashed line 3, and a cylinder core 10 provided in an opening in the cylinder housing 3. The core 10, a longitudinal cross-sectional view of which is shown in FIG. 1, has a cross-sectional outline that resembles an "8". The lower portion of the core contains an essentially cylindrical plug 20 having a plurality of pin tumbler chambers 22 formed therein, in the present example six chambers. In each of the pin tumbler chambers 22 there is provided a pin tumbler spring loaded downwardly by means of a respective spring (not shown). In FIG. 1 there is shown a pin tumbler provided in the innermost chamber which functions as a control pin tumbler in the present invention, as will be explained below. The innermost pin tumbler comprises a bottom pin 24*a*, a top pin 24*c* and a spacer 24*b* provided there between, as is conventional. Corresponding pin tumblers (not shown) are provided in the other pin tumbler chambers 22.

An actuator is provided around the plug 20 at the inner en portion thereof. This actuator comprises a ring 26*a* having an opening 26*b* through which the control pin tumbler extends, see FIG. 3. An outwardly extending actuator pin 26*c* is fixedly attached to the actuator ring and functions to control the movement of a blocking pin 28, as will be explained in the following.

Figure 5:
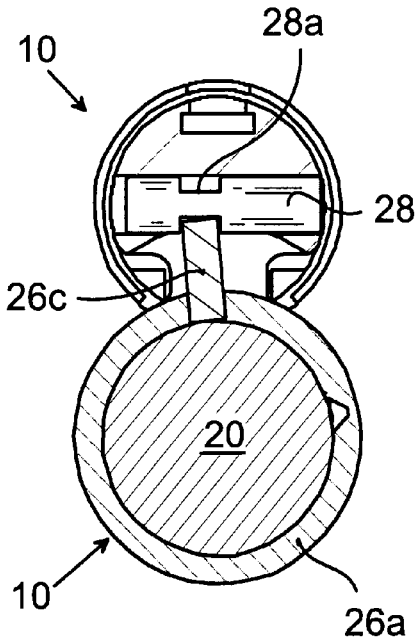
FIGS. 5 and 6 are transverse cross sectional views from lines V-V and VI-VI, respectively, of FIG. 4.

The blocking pin 28 is arranged movably in a transverse channel 30 provided in the upper portion 12 of the core 10. The blocking pin 28 is essentially cylindrical and has a waist portion 28*a* into which the end portion of the actuator pin 26*c* engages, thereby providing a forced motion of the blocking pin by means of the actuator. In an extended position shown in FIG. 2, the blocking pin extends into a cavity 3*a* provided in the inner wall of the opening in the housing 3. In this extended position the blocking pin prevents withdrawal of the cylinder core 10 from the opening in the cylinder housing. In a retracted position shown in FIG. 5, no portion of the blocking pin extends outside of the core 10, thus allowing withdrawal thereof.

Figure 9:
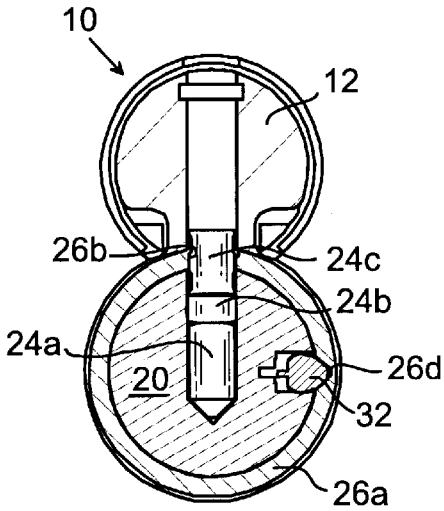

There is also provided a key-controlled sidebar 32. The actuator ring 26*a* is provided with a recess 26*d* on the inner surface thereof to accommodate the sidebar in locked position, as will be described below with reference to FIG. 9.

Figure 3:
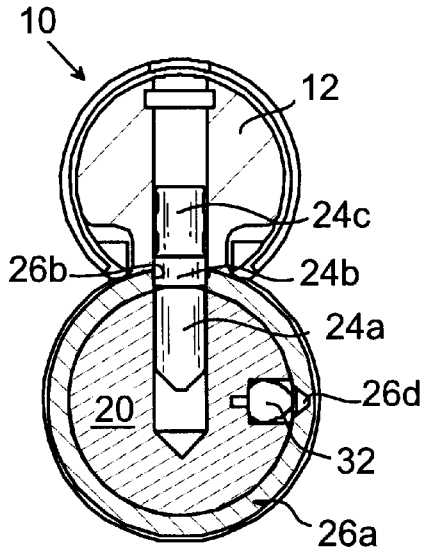
Figure 4:
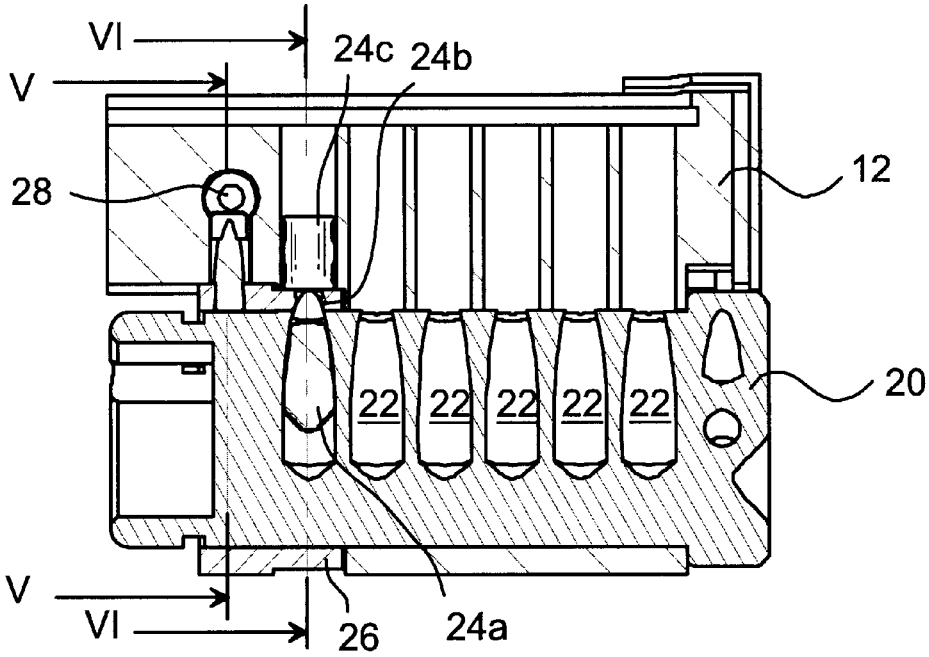
FIG. 4 shows a longitudinal elevation cross section through the lock arrangement according to the invention wherein the blocking pin is disengaged from the lock housing.

In FIG. 3 showing a cross-sectional view of the core 10 taken along the line III-III in FIG. 1 there is seen how the control pin tumbler 24*a–c* extends through the opening 26*b* in the actuator ring 26*a* when a user key (not shown) is inserted into the plug 20. The user key has a key code for the control pin tumbler position, in the present example the inner code position, that lifts the pin tumbler so that the shear line between the bottom pin 24*a* and the spacer 24*b* is on a level with the boundary between the plug 20 and the actuator ring 26*a*. The plug can thus rotate without interfering with the actuator.

Figure 6:
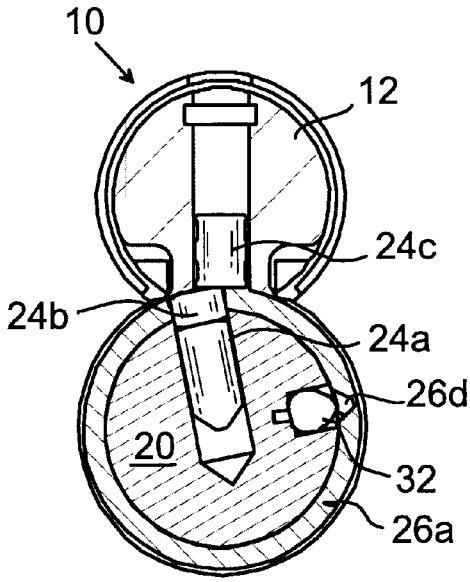
Figure 7:
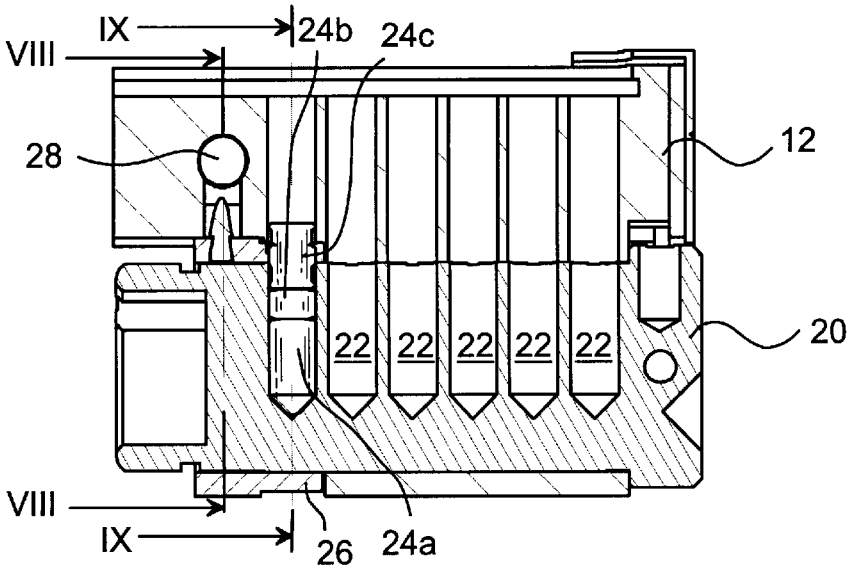
FIG. 7 shows a longitudinal elevation cross section through the lock arrangement according to the invention with no key inserted.
Figure 8:
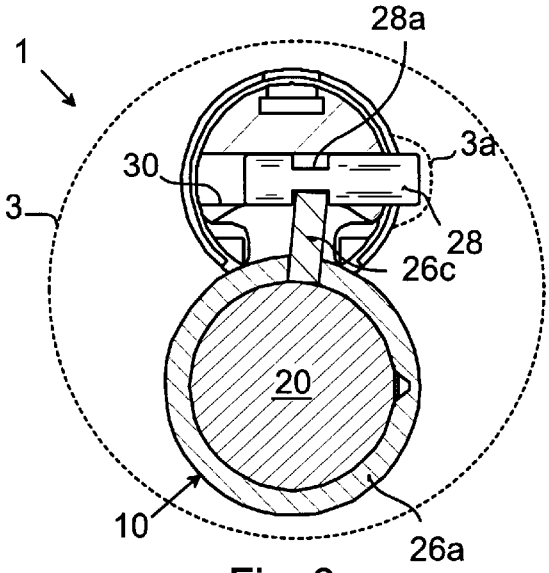
FIGS. 8 and 9 are transverse cross sectional views from lines VIII-VIII and IX-IX, respectively, of FIG. 7.

The spacer 24*b* has a height differing from the thickness of the actuator ring 26*a*. In the position shown in FIG. 3, the spacer extends across the boundary between the actuator ring 26*a* and the upper portion or body 12 of the core 10, thereby fixing the actuator ring against rotation relatively to the core housing. With no key inserted into the lock, se FIGS. 7–9, the upper pin 24*c* instead prevents rotation of the actuator 26. Also, with no key in the lock the sidebar 32 engages the cut-out portion or recess 26*c* of the actuator ring, also preventing mutual rotation of the plug and the actuator. FIG. 6 shows the core with a service key inserted and with the plug rotated slightly counter-clockwise from the position shown in FIGS. 1–3. It is seen that the actuator rotates with the plug because the shear line between the upper pin 24*c* and spacer 24*b* is aligned with the outer surface of the actuator ring 26*a* while the spacer extends across the boundary between the plug 20 and the actuator ring. When rotating, the actuator brings the blocking pin 28 with it, thus moving the blocking pin from the extended blocking position shown in FIG. 2 to the retracted non-blocking position shown in FIG. 5. It is thus seen that the actuator cannot be manipulated with the control pin tumbler in a different position than the one shown in FIG. 6. This provides for a very secure removable core arrangement.

Several advantages are obtained with the described lock device. Firstly, a simple yet reliable solution is provided. Because of the forced movement of the blocking pin, no springs are needed in the blocking arrangement, lowering costs and increasing reliability. Secondly, with the actuator controlled by an ordinary pin tumbler, security is high.

A preferred embodiment of a lock device according to the invention has been described. A person skilled in the art realizes that this could be varied within the scope of the appended claims. Thus, although a pin tumbler having a spacer has been shown, it will be appreciated that a pin tumbler comprising just a top and a bottom pin can be used. The actuator ring has been shown with one hole for one control pin tumbler. To obtain an even more secure arrangement, the actuator ring can be provided with two or even more holes for two or more corresponding control pin tumblers.

What is claimed is:

1. A removable core lock and key device comprising:

a cylinder housing having an opening therein, the inner surface of said opening having a recess;

a cylinder core which is accommodated in said cylinder housing;

an essentially cylindrical plug rotatably arranged in said core and having a key slot for reception of a key;

a blocking pin provided in said core and being movable between an extended position, wherein it engages said recess, and a retracted position, wherein it is disengaged from said recess;

a plurality of pin tumblers provided in said core, each of which pin tumblers blocks rotation of said plug when no key is inserted in said key slot; and an actuator element controlled by at least one control pin tumbler of said pin tumblers, wherein:

in a first position of said control pin tumbler with a control key in said key slot, said control pin tumbler rotates said actuator element with the rotation of said plug so that said actuator element moves said blocking pin between said extended and retracted positions;

in at least one second position of said control pin tumbler with a user key in said key slot, said control pin tumbler is disengaged from said actuator element and said plug is free to rotate while said control in tumbler blocks rotation of said actuator element; and in a position of said control pin tumbler with no key in said key slot, said control pin tumbler blocks rotation of said plug and said actuator element.

2. The device according to claim 1, wherein said actuator element comprises an actuator ring arranged around said plug, said ring having a hole for said at least one control pin tumbler.

3. The device according to claim 2, wherein said at least one control pin tumbler comprises a bottom pin, a spacer, and a top pin, and wherein said spacer has a height differing from a thickness of said actuator ring.

4. The device according to claim 3, wherein, with a user key in said key slot, said control pin tumbler is positioned so that a shear line between said bottom pin and said spacer is on a level with a boundary between said plug and said actuator ring, and, with a control key in said key slot, said control pin tumbler is positioned so that a shear line between said spacer and said top pin is on a level with a boundary between said actuator ring and a housing of said cylinder core.

5. The device according to claim 1, wherein said actuator element comprises an actuator pin controlling the movement of said blocking pin.

6. The device according to claim 5, wherein the movement of said blocking pin is controlled by means of forced motion.

7. The device according to claim 6, wherein said blocking pin comprises a waist portion, into which an end portion of said actuator pin engages.

8. The device according to claim 1, wherein said at least one control pin tumbler comprises a bottom pin, a spacer, and a top pin.

9. The device according to claim 1, comprising a key-controlled sidebar arranged to engage a recess in an inner surface of said actuator ring in a locked position of the lock and key device.

* * * * *